US006439501B1

(12) United States Patent
Harmathy

(10) Patent No.: US 6,439,501 B1
(45) Date of Patent: Aug. 27, 2002

(54) DISPENSER OF ROLLED-UP SHEET MATERIALS

(76) Inventor: Tibor Zoltan Harmathy, 1834 Playfair Dr., Ottawa, ON, K1H 5S1 (CA)

( * ) Notice: Subject to any disclaimer, the term of this patent is extended or adjusted under 35 U.S.C. 154(b) by 0 days.

(21) Appl. No.: 09/549,302

(22) Filed: Apr. 13, 2000

(51) Int. Cl.[7] ..... B65H 16/06

(52) U.S. Cl. ..... 242/565; 242/596.4; 242/596.7; 242/598.3; 242/599.4

(58) Field of Search ..... 242/565, 596.4, 242/596.7, 596, 598, 598.3, 599, 599.4

(56) References Cited

U.S. PATENT DOCUMENTS

| | | | | | |
|---|---|---|---|---|---|
| 452,719 | A | * | 5/1891 | Ross | 225/82 |
| 1,243,569 | A | * | 10/1917 | Taylor | 225/51 |
| 1,286,599 | A | * | 12/1918 | Johnson | |
| 1,651,434 | A | * | 12/1927 | Bell | 242/595 |
| 1,837,507 | A | * | 12/1931 | Towers | 242/419.4 |
| 1,975,414 | A | * | 10/1934 | Wade | |
| 2,488,492 | A | * | 11/1949 | Dumbleton | 242/598.5 |
| 3,494,518 | A | * | 2/1970 | Goss | 225/46 |
| 4,285,474 | A | * | 8/1981 | Perez | |
| 4,454,974 | A | * | 6/1984 | Cooke | 225/106 |
| 4,467,974 | A | * | 8/1984 | Crim | 242/419.4 |
| 4,881,675 | A | * | 11/1989 | Varley | 225/43 |
| 4,913,364 | A | * | 4/1990 | Hu | 242/598.5 |
| 4,919,350 | A | * | 4/1990 | Miller | |
| 5,054,675 | A | * | 10/1991 | Taves | 225/20 |
| 5,215,274 | A | * | 6/1993 | Lin | |
| 5,249,755 | A | * | 10/1993 | Jespersen | 242/596.7 |
| 5,273,227 | A | * | 12/1993 | Smith, Jr. | |
| 5,415,357 | A | * | 5/1995 | Smith, Jr. | 42/160.1 |
| 5,467,935 | A | * | 11/1995 | Moody | |
| 5,651,487 | A | * | 7/1997 | Hansen | 225/106 |
| 5,758,843 | A | * | 6/1998 | Ongaro | 242/565 |
| 5,794,882 | A | * | 8/1998 | Lewis | 242/423.1 |
| 5,938,142 | A | * | 8/1999 | Halperin | 242/423.1 |
| 5,998,561 | A | * | 11/1999 | Mele | 242/599.1 |

FOREIGN PATENT DOCUMENTS

| | | | | |
|---|---|---|---|---|
| DE | 1294626 | * | 5/1969 | 242/598.5 |
| FR | 1440814 | * | 4/1966 | 242/595 |

* cited by examiner

*Primary Examiner*—William A. Rivera

(57) ABSTRACT

Device that enables a person to separate from a roll any length of flexible sheet material, typically toilet paper or paper kitchen towel. The moving parts of the device consist of a rotor, to which the roll is firmly attached, and an L-shaped braking arm that has a limited freedom of movement around a peg that can be added to any conventional roll-holding device. The free end of the roll is slid through a slit in one leg of the L. Directing the pull on the roll's free end up or down, the arm will bend slightly upward or downward. When bent upward, a smooth section of an opening in the other leg of the L becomes engaged with a section of the rotor consisting of a sprocket or gear (Variant A), or with a cylindrical surface of the rotor (Variant B), and thus the rotor/roll assembly is allowed to turn unimpeded under the effect of pull on the end of the roll. When bend downward, the sprocket or gear of the rotor becomes engaged with a protrusion in the same opening of the arm (Variant A), or the said cylindrical surface of the rotor becomes engaged with a braking surface in the same opening (Variant B), and thereby the rotor/roll assembly will stop turning. Increasing the pull, a piece of the roll outside slit will tear off.

6 Claims, 3 Drawing Sheets

2

DISPENSER OF ROLLED-UP SHEET MATERIALS

CROSS-REFERENCE TO RELATED APPLICATIONS

Application Ser. No. 09/072,580 for Toliet paper or paper towel dispenser. The object of this invention is similar to that of the present invention, but the solution is different.

BACKGROUND OF INVENTION

Various flexible sheet materials are marketed in the form of strips rolled up usually on a paper tube. In facilitate the separation of pieces from the roll, the manufacturers, as a rule, divide the sheet into unit pieces by providing lines of weakness, e.g. perforations, at regular intervals. Toliet papers and paper kitchen towels are the most common examples of such flexible sheet products. In the following text, the term "roll" will be used to denote any kind of flexible sheet material marketed in rolls.

People often find it annoying that separating a piece from the roll requires both hand: one to pull the material off the roll, and the other to prevent the roll from overspinning on its spindle when the pull is increased in order to separate the piece. It may happen that one hand of the user is dirty or wet, and therefore the material still on the roll become unsanitary or weakened by moisture. It may also happen that one hand of the user is disabled or occupied with holding some object.

Many devices have already been patented that enable a person to separate a piece with one hand from the roll. With most of them, unrolling is done by pulling the material off the roll in one direction, and separating is done by changing the direction of the pull or by exerting a sudden tug on the free end of the roll. The majority of these devices use techniques belonging in one of the following three groups: (1) Preventing the overspinning the roll is achieved by braking the turning of the roll at its periphery; (2) Preventing the overspinning of the roll is achieved by braking the turning of the roll at its core; (3) Preventing the overspinning of the roll is achieved by braking the movement of an already unrolled piece of material.

U.S. Pat. No. 452,719, U.S. Pat. No. 3,494,518, U.S. Pat. No. 4,285,474, U.S. Pat. No. 4,913,364, U.S. Pat. No. 4,919,350, U.S. Pat. No. 5,054,675, U.S. Pat. No. 5,651,487, FR. Patent No. 1,440,814, and DR. Patent No. 1,294,626 are examples of devices belonging in the first group; U.S. Pat. No. 1,243,569, U.S. Pat. No. 2,488,492, U.S. Pat. No. 5,215,274, U.S. Pat. No. 5,249,755, U.S. Pat. No. 5,273,227, U.S. Pat. No. 5,415,357, U.S. Pat. No. 5,758,843, U.S. Pat. No. 5,794,882, U.S. Pat. No. 5,938,142, and U.S. Pat. No. 5,988,561 are examples of those in the second group; and U.S. Pat. No. 1,651,434, U.S. Pat. No. 1,837,507, U.S. Pat. No. 4,454,974, U.S. Pat. No. 4,467,974, and U.S. Pat. No. 4,881,675 are examples of those in the third group.

Several difficulties have been encountered, however, with the patented devices. Among them: preventing the roll from overspinning may not be satisfactorily achieved at all possible weight and size of the roll, or the length of the piece to be separated may be limited to one unit piece, or the installation of the roll in the device may be time-consuming, or the device may be costly for mass manufacture. A further factor that may discourage people from using most of the patented devices is that they already have simple, conventional devices for the intended purpose, and the advantages offered by the newer devices do not seem to justify buying a new dispenser.

The device to be described here is simple, reliable, inexpensive, and allows a person to separate from the roll any length of the material measured in multiples of the unit piece. Its main advantage is, however, that with a simple modification—that can be done by any person who knows how to use a drill—it can be added to a roll-dispenser already owned. The device belongs in the second group; i.e., preventing the overspinning of the roll is done by braking the turn of the roll at its core.

BRIEF SUMMARY OF INVENTION

The roll dispenser to be described here enables a person to separate with one hand a piece from a roll of a flexible sheet material, typically toilet paper or paper kitchen-towel. The novel parts of the device consist of a rotor, to which the conventional spindle of the holding base and the roll are firmly attached, and an L-shaped braking arm, which has a limited freedom of bending up or down around a small peg installed in the holding base. Since the free end of the roll is slid through a slit in leg of the L, directing the pull on the free end of the roll up or down the arm can be slightly lifted or lowered. When bent upward, a smooth section of an opening in the outer leg of the arm will be brought in contact with the rotor, and thereby the spindle/rotor/roll assembly is allowed to turn unimpeded. When bent downward, another section of the opening in the arm will be brought in contact with the rotor and cause the assembly to stop turning. By increasing the pull on the free end of the roll, a piece of the roll outside the slit can be torn off.

BRIEF DESCRIPTION OF THE SEVERAL VIEWS OF THE DRAWING

In the drawings that illustrate the embodiments of the invention.

DETAILED DESCRIPTION OF THE INVENTION

Figure 1:
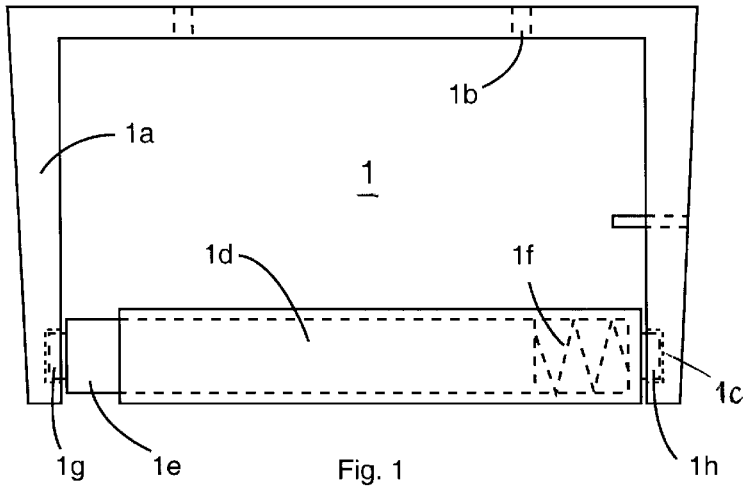
FIG. 1 is an elevational view of a commonly used roll-holding device, adapted to the dispenser to be described.
Figure 2:
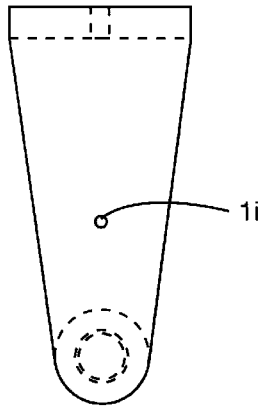
FIG. 2 is the side-view that holding assembly taken from the right.

Shown in FIGS. 1 and 2, the roll-holding device 1 is a component probably already owned by the user. It may, however, be purchased as an integral part of the roll-dispenser. It consists of a stable U-shaped holding base 1*a,* which has holes 1*b* for screws for fastening the base to a solid surface. The side arms of the base have holes or indentations 1*c* for accommodating a spindle, which itself consists of three parts: a hollow outer cylinder 1*d,* an inner cylinder 1*e,* and a spring 1*f* that causes the nipples 1*g* and 1*h* of the two cylinders to snap into the holes or indentations 1*c* on the side arms. If already owned, the holding device can be adapted to the dispenser to be described here by inserting (screwing or pasting) a small peg 1*i* into one of the arms of the base at an appropriate location.

Figure 3:
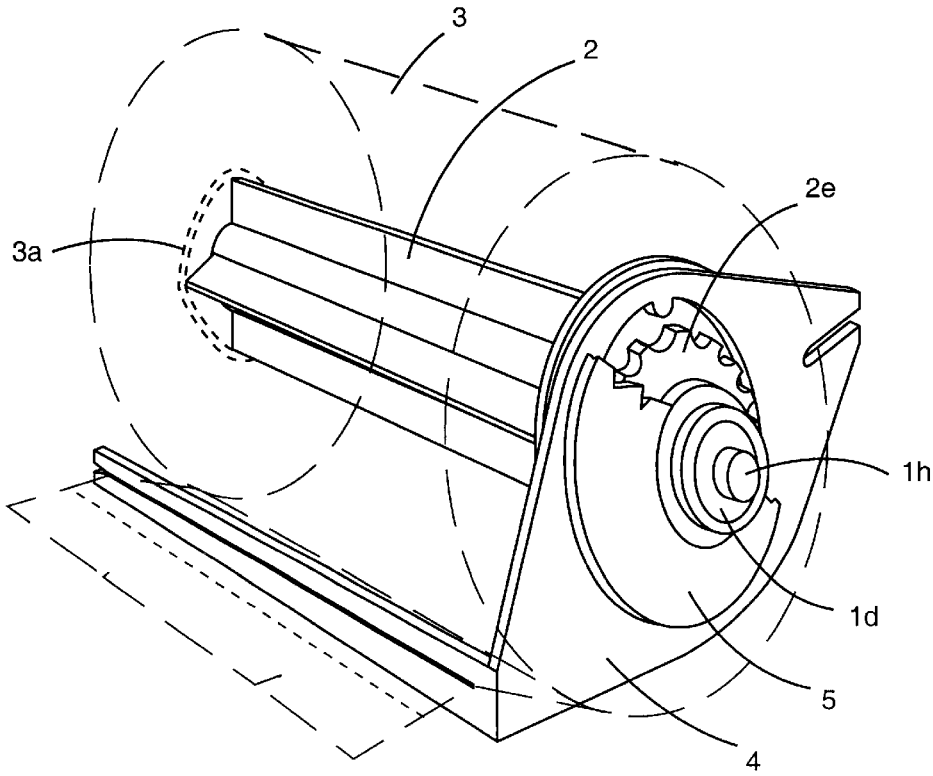
FIG. 3 is a perspective view of the moving parts of Variant A of the roll dispenser, with the roll and its core shown in broken lines, and a disk partially broken off to reveal the mode of braking.
Figure 4:
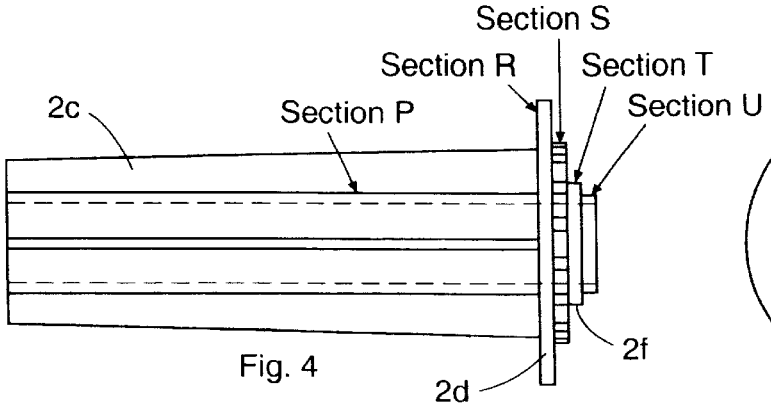
FIG. 4 is an elevational view of Variant A of the rotor.
Figure 5:
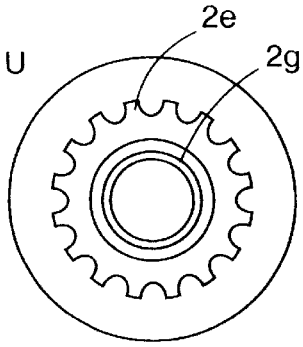
FIG. 5 is a side view of Variant A of the rotor taken from the right.
Figure 6:
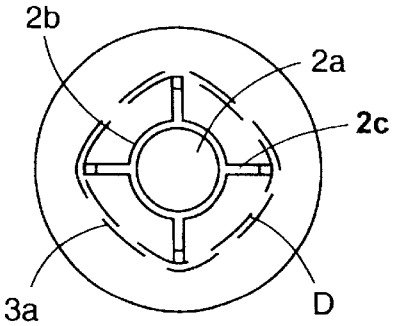
FIG. 6 is a side view of the rotor taken from the left, with the core of the roll shown in broken lines.

As shown in FIGS. 4, 5 and 6, Variant A of the rotor 1 has a hole 2*a* running through, the diameter of which is infinitesimally larger that the diameter of the outer cylinder 1*d* of the spindle. The outside surface of rotor can be divided into five sections: Sections P, R, S, T and U. Section P has a cylindrical base 2*b,* to which ribs 2*c* are attached. Section R consists of a disk 2*d.* The ribs 2*c* along Section P protrude from the cylindrical base in such a way that at the left end of the rotor (in FIG. 4) the distance between the outer edges of the ribs is only slightly larger than the diameter of the paper tube that forms the core 3*a* (shown in dashed lines in FIG. 3 and 6) of the roll 3 (also shown in dashed lines in FIG. 3) to be installed on the rotor. That distance increases on approaching disk 2*d.* The purpose of this design is that when the roll is installed on the rotor from the left, the core of the roll will slightly deform into a shape between a circle and a rectangle, as indicated by letter D in FIG. 6. In this way the roll will be made to turn together with the rotor. Section S consists of a sprocket or gear 2*e,* the outside diameter of which is significantly less than that of disk 2*d.* Section T is formed by a cylindrical surface 2*f.* Zone U is also formed by a cylindrical surface 2*g;* its role is simply to provide some space between the end of the rotor and the side arm of holding base 1*a.*

Figure 7:
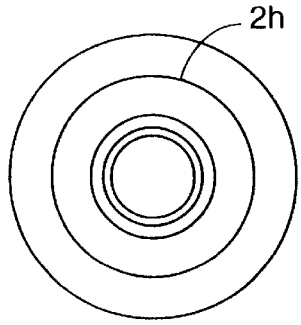
FIG. 7 is a side view of Variant B of the rotor taken from the right.

Variant B of the rotor is similar to Variant A in all respects except, as FIG. 7 shows, Section S consists of a simple cylindrical surface 2*h,* instead of a sprocket or gear.

Figure 9:
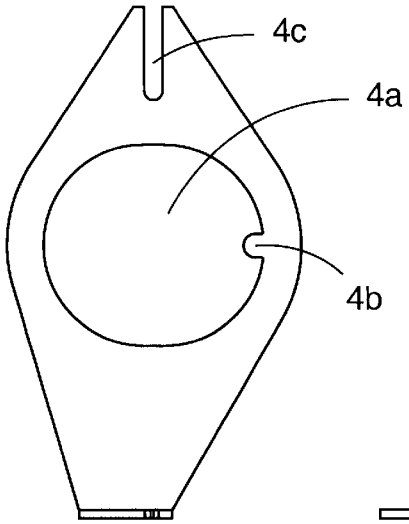
FIG. 9 is a side view of Variant A of the braking arm taken from the left.
Figure 8:
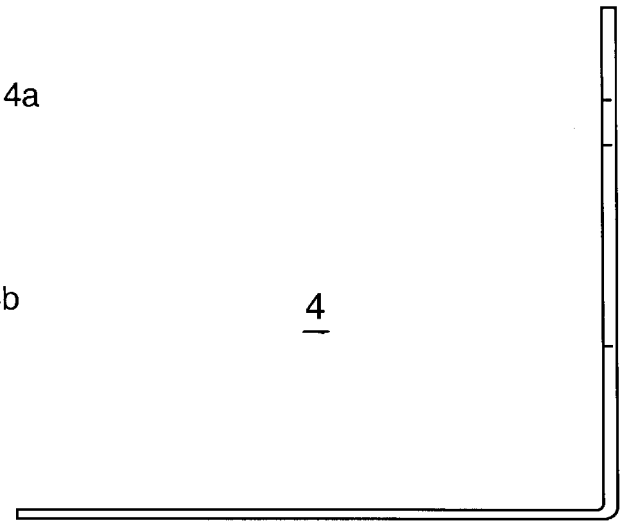
FIG. 8 is an elevational view of Variants A or B of the braking arm.
Figure 10:
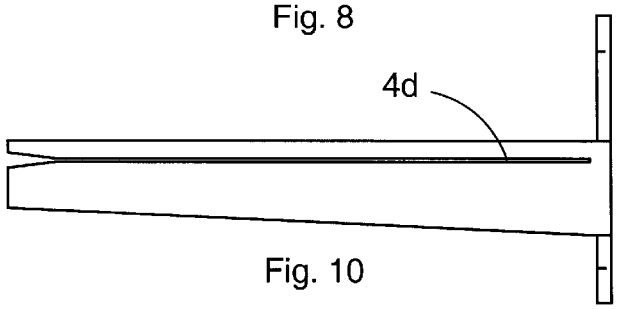
FIG. 10 is a side view of Variants A or B of the braking arm taken from below.

Variant A of the braking arm 4, shown in FIGS. 8, 9 and 10, is an L-shaped component. One side of the L, shown in FIG. 9, has an oval opening 4*a,* with a small protrusion 4*b* on one side of its longitudinal axis. The size of this protrusion is such that it can penetrate any of the gaps in the sprocket or gear 2*e* of the rotor. The lesser dimension of the opening is sufficient to accommodate the sprocket or gear 2*e* of the rotor, and its larger dimension is greater than the outside dimension of the sprocket or gear plus the height of the protrusion. The thickness of this side of the arm is only slightly less than the width of Section S of the rotor. There is also a slot 4*c* on this side of the L-shaped arm, to accommodate the small peg 1*i* in one of the side arms of holding base 1*a.* The other side of the L, shown in FIG. 10, has a narrow slit 4*d* in it, which runs throughout the length of this side.

Figure 11:
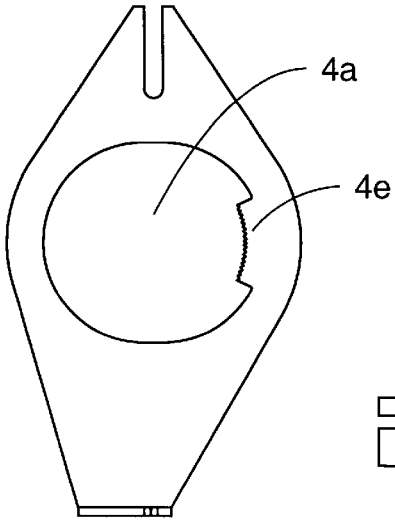
FIG. 11 is a side view of Variant B of the braking arm taken from the left.

Variant B is similar to Variant A in all respects except, as FIG. 11 shows, in opening 4*a,* instead of a protrusion 4*b,* the braking arm has a short braking surface 4*e,* which may be roughened or serrated for better effect. The lesser dimension of the opening is sufficient to accommodate disk 2*h* of the rotor, and its larger dimension is greater than the diameter of disk 2*h* plus the height of the braking surface 4*e.*

Figure 13:
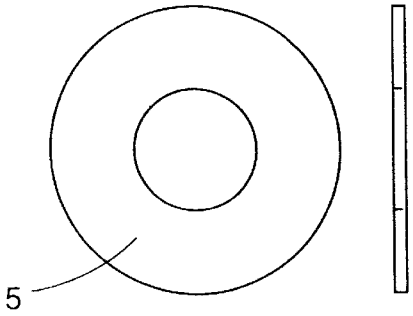
FIG. 13 shows two views of a disk.

The disk 5 shown in FIG. 13 has an inside diameter infinitesimally larger than that of the cylindrical surface 2*g* forming Section T of the rotor, and an outside diameter about the same as that of disk 2*d* forming Section R. The thickness of this disk is equal to the width of Section T.

The roll-dispenser is assembled as follows. The opening in the braking arm 4*a* is placed over Section S of the rotor in a position shown in FIG. 3, then disk 5 is permanently fastened (e.g., by pressing or gluing, dependent on the materials used) to the rotor over Section T. The wider side of the L-shaped braking arm is now sandwiched between disks 2*d* and 5. Finally, the spindle of the holding device is pushed through hole 2*a* of the rotor, and the spindle's outer cylinder 1*d* is permanently fastened (e.g. by pressing or gluing, dependent on the materials used) to the rotor in a position to enable slot 4*c* in the braking arm to engage with peg 1*i* in one of the arms of the holding base when the spindle/rotor/braking arm assembly is installed into the holding base.

FIG. 3 shows a roll mounted on the spindle/rotor/braking arm assembly. The mounting takes place as follows. First a few unit pieces of the roll 3 is unwound. Then the core 3*a* of the roll is pushed over the ribs 2*c* of the rotor, whereby the roll becomes solidly attached to the spindle/rotor/braking arm assembly. At the same time, the unwound end of the roll is slid through slit 4*d* in the braking arm. Finally, nipples 1*g* and 1*h* of spindle are snapped into the indentations or holes 1*c* in the side arms of the holding base in such a way to allow slot 4*c* in the braking arm to engage with peg 1*i.*

In using the device, first the unwound free end of the roll is pulled at an upward angle through slit 4*d,* thereby causing the braking arm 4 to bend upward around peg 1*i.* In this way the smooth lower side of opening 4*a* in the braking arm will get in contact with the sprocket or gear 2*e* (with Variant A), or with the circular surface 2*h* (with Variant B) of the rotor, and the roll/spindle/rotor assembly is allowed to turn unimpeded as the free end of the roll is pulled through slit 4*d.* When the direction of the pull is changed downward and the braking arm bends downward around peg 1*i,* protrusion 4*b* in opening 4*a* of the breaking arm will penetrate one of the gaps in the sprocket or gear 2*e* of the rotor (with Variant A), or the braking surface 4*e* will be pressed against the cylindrical surface 2*h* of the rotor (with Variant B), whereby the turning of the roll/spindle/rotor assembly is stopped. Increasing the downward pull on the free end of the roll, one or more unit pieces of the roll outside slit 4*d* will separate from the roll along a line of weakness.

It may happen that, after the separation of the required piece, the free end of the roll bounces back through the slit. To prevent this eventuality, the slit 4*d* in the braking arm should be very thin, and instruction for the use of the device should mention that at least half a unit piece preceding the piece to be torn off be outside the slit when the downward pull is increased.

Figure 12:
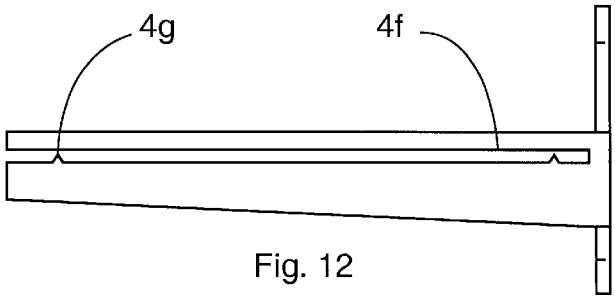
FIG. 12 is a side view of yet another variant the braking arm taken from below.

Another solution for coping with this eventually is to make the slit somewhat wider, shown as 4*f* in FIG. 12, and to have the lower edge of the slit equipped with two sharp protrusions 4*g* near the ends of the slit. These protrusions penetrate the material of the roll when the downward pull is increased, and prevent the free end of the roll from bouncing back through the slit after the required piece is separated.

What I claim as my invention is:

1. A device for dispensing any flexible sheet material rolled up on a core, the device comprising: a holding device including a U-shaped holding base, the U-shaped holding base having at least two arms, said arms having two opposed facing recesses; a peg mounted in at least one of said arms and adjacent to one of said recesses; a collapsible spindle made up of two interacting cylinders pushed apart by a spring, and equipped with nipples that fit into said recesses in the arm of the holding base; a rotor firmly attached to the roll of said flexible sheet material so that the two turn together; and an L-shaped braking arm, one side of which has an opening that interacts with the rotor and a slot that interacts with the peg installed in the holding base; the other side of the L-shaped arm is provided with a slit having a first width for guiding the free end of the rolled material installed in the device, and which serves to pivot the arm upward or downward around the peg in the base by directing the free end of the roll upward or downward.

2. Device defined in claim 1, in which the interaction between the rotor and the braking arm is achieved by attaching the braking arm to the rotor in such a way that the side of the braking arm with the opening is movably sandwiched between a disk of the rotor and another disk mounted on to the rotor after the attachment of the arm.

3. Device defined in claim 1, in which the section of the rotor that interacts with the braking arm is a sprocket or gear; and the opening in the braking arm is oval, along the longer axis of which on one side the surface is smooth, so that the sprocket or gear when in contact with this surface can turn unimpeded, and on the opposite side of the longer axis of the oval opening there is a protrusion that, when pressed against the sprocket or gear, penetrates a gap in said sprocket or gear, thereby stopping the turning of the rotor/roll assembly.

4. Device assembly in claim 1, in which the section of the rotor that interacts with the braking arm is a cylindrical surface, and the opening in the braking arm is oval, along the longer axis of which on one side the surface is smooth, so that the cylindrical surface of the rotor when in contact with this surface can turn unimpeded, and on the opposite side of the longer axis of the oval opening there is a braking surface that, when pressed against the said cylindrical surface, stops the turning of the rotor/roll assembly.

5. Device defined in claim 1, in which the slit in the braking arm has a second width greater than the first width, and the lower edge of said slit near the ends is provided with two sharp protrusions that penetrate the material of the roll as the downward pull on the free end of the roll is increased, and thereby prevent the material from bouncing back through the slit after the desired length of material is separated from the roll.

6. Device defined in any of the preceding claims, wherein the rotor and the collapsible spindle are permanently bonded.

* * * * *